United States Patent [19]

Shaw et al.

[11] 4,013,491

[45] Mar. 22, 1977

[54] INCENDIARY COMPOSITIONS OF MAGNESIUM AND FLUOROALKYL PHOSPHATE ESTERS

[75] Inventors: Graham C. Shaw, Garland, Utah; Russell Reed, Jr., Ridgecrest, Calif.

[73] Assignee: Thiokol Corporation, Newtown, Pa.

[22] Filed: May 14, 1975

[21] Appl. No.: 577,199

[52] U.S. Cl. ..... 149/19.3; 149/30; 149/31; 149/37; 149/121

[51] Int. Cl.[2] ..... C06B 45/10; C06B 39/06; C06B 39/02; C06B 33/00

[58] Field of Search ..... 149/19.3, 30, 31, 37, 149/87, 121; 260/955, 963

[56] References Cited

UNITED STATES PATENTS

| | | | |
|---|---|---|---|
| 2,754,318 | 7/1956 | Conly | 260/955 |
| 3,083,224 | 3/1963 | Brace | 260/955 |
| 3,156,595 | 11/1964 | Camp | 149/87 |
| 3,288,890 | 11/1966 | Blake | 260/955 |
| 3,308,207 | 3/1967 | Seil | 260/955 |
| 3,308,208 | 3/1967 | Seil | 260/955 |
| 3,565,706 | 2/1971 | Waite | 149/19.3 |
| 3,632,458 | 1/1972 | Filter | 149/19.3 |
| 3,666,712 | 5/1972 | Weil | 260/963 |
| 3,669,020 | 6/1972 | Waite | 149/19.3 |

*Primary Examiner*—Samuel W. Engle
*Assistant Examiner*—Donald P. Walsh

[57] ABSTRACT

Metal-penetrating incendiary compositions comprising particulate magnesium and fluoroalkyl phosphate esters of 5 to 11 carbon atoms, optionally containing additives such as ferric oxide, silicon and potassium perchlorate. The compositions can be prepared in paste form, cast and cured at an elevated temperature.

11 Claims, No Drawings

INCENDIARY COMPOSITIONS OF MAGNESIUM AND FLUOROALKYL PHOSPHATE ESTERS

This invention relates to incendiary compositions and more particularly, to castable metal-penetrating incendiary compositions.

Incendiary compositions for military applications are usually one of two types, namely, jellied hydrocarbon fuels for use on "soft" targets, i.e., materials that are readily ignitable, and thermite-type incendiaries for use on "hard" targets, e.g., metals. The latter type of composition commonly comprises a metal in particulate form, e.g., magnesium or aluminum and an oxidizing agent, and it is formulated to burn at a temperature sufficiently high to melt and form holes in sheet metal, i.e., metal plates or containers. The present invention is concerned with metal-penetrating incendiary compositions of this general type.

In order to achieve a concentrated burning capacity at a relatively high temperature, such compositions should burn with a low level of gas production, since the gas produced as an incident of the oxidation reaction tends to absorb the heat of reaction and remove it from the reaction system. Also it is desirable that the composition be castable, i.e., capable of being formulated in fluid form, cast into a desired configuration and thereafter cured to solid form.

It is known from U.S. Pat. No. 3,156,595 that heat-generating compositions based on oxidation of metals and having a low level of gas production can be prepared from finely divided aluminum or magnesium and a fluorocarbon oil as the oxidizing agent. However, such compositions are not curable and hence cannot be cast into a desired configuration and subsequently cured to solid form.

It is further known from U.S. Pat. No. 3,565,706 that castable curable compositions can be made by using, in combination with a finely divided metal, a polymerizable fluorocarbon that is a liquid and is capable of being converted into solid form. More particularly, this patent discloses that metal powder can be mixed with a dodecafluoroheptyl methacrylate and certain other acrylates and methacrylates, cast in a desired shape and thereafter cured with a benzoyl peroxide catalyst in the presence of an amine activator. While such compositions have the desired curability and low gas production, they still leave room for improvement in respect to the rapidity with which they develop high temperatures upon ignition. Also they require the use of a separate catalyst and activator for curing.

It is accordingly an object of the present invention to provide a metal-penetrating incendiary composition which is castable and curable, has a low gas production and upon ignition reacts with exceptional speed and vigor. It is another object of the invention to provide a composition of this type that is curable without added catalyst. It is still another object of the invention to provide a composition of this type that can be formulated with a less expensive fluorocarbon than those used in the previously proposed compositions. Other objects of the invention will be in part obvious and in part pointed out hereafter.

The present invention is based on the discovery that exceptionally effective metal-penetrating incendiary compositions can be obtained by using particulate magnesium in conjunction with an oxidizer which is a liquid fluoroalkyl phosphoric acid ester or a mixture of such esters. In accordance with a preferred embodiment of the invention, magnesium powder and one or more liquid fluoroalkyl phosphate esters, optionally in combination with certain special purpose additives, are mixed to form a paste that can be readily cast into a desired configuration and cured at a moderately elevated temperature, say 135° F., to a solid material. The cured composition when ignited burns vigorously and rapidly and is capable of forming sizable holes, say ½ inch to ¾ inch in diameter, in sheet metal of a thickness commonly used in making containers such as 50-gallon drums.

The fluoroalkyl phosphate esters used are esters of phosphoric acid and fluoroalkanols having say 5 to 11 carbon atoms. The esters may be mono-esters or di-esters or mixtures of mono- and di-esters. Representative alcohols from which the esters can be prepared are 1,1,7-trihydrododecafluoroheptyl, 1,1,5-trihydrooctafluoropentyl, 1,1,9-trihydrohexadecafluorononyl, 1H,1H,2H,2H-tridecafluorooctyl, 1H,1H,2H2H-pentadecafluorononyl, 1H,1H,2H,2H-heptadecafluorodecyl, and 1H,1H-pentadecafluorooctyl alcohols.

A number of such phosphate esters are commercially available. One commercial product that may be used in the present compositions is sold under the trade designation Zonyl S-13 which is understood to be a mixture of approximately equal proportions of a mono- and di-ester in which the organic groups are trihydrofluoroalkyl radicals having an average of about 7 carbon atoms. Another fluoroalkyl phosphate ester that may be used has the trade designation TLF-1914 and is understood to be a mixture of approximately equal proportions of mono- and di-ester wherein the organic groups can be represented by the general formula $C_mF_{2m}+1 \cdot C_nH_{2n}O$ wherein $n$ is 2 and $m$ is 6 to 8. Still another product that can be used is identified as TLF-1916 and is similar to TLF-1914 but differs therefrom in that it comprises about 85% of monoester and 15% of diester. A method of preparing fluoroalkyl phosphate esters is described in U.S. Pat. No. 3,083,224.

While we do not wish to be bound by any particular theory as to the mechanism of the reaction which takes place between the components of the present compositions, it is our present understanding that the fluoroalkyl phosphoric acid esters are attached to the metal by a chemisorption process, and that upon ignition a condensed phase reaction occurs which results in a high combustion temperature and enhanced metal burning capabilities without any substantial evolution of gases that would carry heat away from the focal point of the reaction.

As indicated above, it has further been found that the compositions containing the magnesium and perfluoroalkyl phosphate esters can be effectively cured to a solid state even though the esters contain no ethylenically unsaturated groups and no catalyst is present. It appears that curing of the composition may be due to the fact that the mono-esters are difunctional in respect to the phosphoric acid group and that these reactive acid groups react with the magnesium to effect a cross-linking or hardening of the paste.

In most cases it is desirable to include in the incendiary composition one or more materials that may be roughly characterized as heat-transfer promoters, i.e., materials that provide reaction products that are liquid and do not generate substantial volumes of gas which would tend to carry off the heat generated by the principal reaction. Such materials include, for example, iron oxides, manganese dioxide and elemental silicon. The addition of iron oxide to the fluorocarbon ester/-magnesium mixture produces an exothermic reaction between the magnesium and iron oxide to provide a molten iron flux which provides increased heat transfer to the metal surface to be penetrated. Addition of powdered silicon metal and coarse potassium perchlorate to the composition increases the effectiveness of melting or burning holes in the metal to be penetrated. The elemental silicon appears to form a silicate which may combine with the oxidized magnesium to form a lower melting flux than magnesium oxide, an effect which provides increased heat transfer to the metal surface.

Coarse potassium perchlorate is also an effective additive. It appears to decompose near the surface of the metal to be penetrated, thus oxidizing the locally heated metal in a sufficiently vigorous manner to cause the formation of large holes therein. The use of a relatively coarse potassium perchlorate having a particle size of say 150 to 300 microns, was found to be more effective than the use of a finer potassium perchlorate. Also a granular form of lithium perchlorate of approximately the same particle size as the potassium perchlorate can be substituted therefor.

The proportions of the principal components, namely, particulate magnesium and the fluoroalkyl phosphate ester and the amount and nature of the special purpose additives can be varied substantially. Considering only the total amount of magnesium and phosphate ester present in the composition, the proportion of magnesium is preferably from 35% to 75% by weight of the total weight of these two components and thus the proportion of ester is preferably from 25% to 65%. As indicated above, incendiary compositions embodying the present invention can advantageously contain, in addition to the magnesium powder and fluoroalkyl phosphate ester, ferric oxide, elemental silicon and potassium perchlorate. When these additives are used, the components are desirably present to the extent of about 28% to 35% of ferric oxide, 24% to 32% by weight of magnesium powder, 10% to 15% by weight of particulate silicon, and 10% to 25% by weight of potassium perchlorate.

In accordance with a typical method of preparing the present compositions, the ingredients other than the magnesium powder are mixed in a mechanical mixer while being heated to a temperature of say 80° to 130° F. to help liquify the fluoroalkyl phosphate ester. After 5 to 10 minutes of mixing the magnesium powder is added and mixing continued for another 10 minutes. The resulting composition may be cast into the desired shape and cured at 135° F. for a period of 3 hours.

The cured compositions can be ignited in any suitable and well known way. In controlled tests ignition was effected with a gas/oxygen torch, but pyrogens such as potassium nitrate and boron or aluminized propellants containing 10 to 20% binder, 10 to 24% aluminum, 55 to 80% ammonium perchlorate oxidizer and 0 to 12% iron oxide can be used. Ignition can be effected by placing readily ignitable compositions adjacent to the incendiary and using an igniter squib or hot wire in known manner. In order to point out more fully the nature of the present invention, several Examples of incendiary compositions embodying the present invention are given in Table I below. All amounts are given in parts by weight.

Table I

| Component | A | B | C |
|---|---|---|---|
| Fluoroalkyl phosphate ester (Zonyl S-13) | 32 | 32 | 29 |
| Ferric Oxide | 12 | 12 | 11 |
| Magnesium Powder | 28 | 28 | 26 |
| Silicon | 12 | 12 | 11 |
| Potassium perchlorate (150 to 300 microns) | 16 | — | — |
| Lithium perchlorate (150 to 300 microns) | — | 13 | 23 |

Three gram samples of Compositions A, B and C above were tested to determine their ability to burn through the lids of No. 1 tin plate cans. In each case a three gram sample burned through two such lids. Twenty-five gram samples of composition A burned through a mild steel plate (0.041 inch) which was equivalent in thickness and in metal type to the sheet metal used in making a 50-gallon drum.

It is, of course, to be understood that the foregoing description is illustrative only and that numerous changes can be made in the ingredients, proportions and conditions disclosed without departing from the spirit of the invention as defined in the appended claims.

We claim:

1. An incendiary composition consisting essentially of particulate magnesium and a mono- or difluoroalkyl phosphate ester or mixture of said fluoroalkyl phosphate esters wherein the alkyl group or groups are all fluoroalkyl groups and have 5 to 11 carbon atoms.

2. A composition according to claim 1 wherein said fluoroalkyl phosphate ester is a mixture of monofluoroalkyl phosphate ester and difluoroalkyl phosphate ester.

3. A composition according to claim 2 wherein the alkyl groups of said mixture have an average of 7 carbon atoms.

4. An incendiary composition consisting essentially of particulate magnesium, an inorganic oxidizer and a mono- or di-fluoroalkyl phosphate ester or mixture of said fluoroalkyl phosphate esters wherein the alkyl group or groups are all fluoroalkyl groups and have 5 to 11 carbon atoms.

5. An incendiary composition containing as its essential active ingredients particulate magnesium and mono- and/or di-fluoroalkyl phosphate ester wherein the alkyl groups are all fluoroalkyl groups and each has 5 to 11 carbon atoms.

6. An incendiary composition containing 35 to 75% by weight of particulate magnesium and 25 to 65% by weight of mono- and/or di-fluoroalkyl phosphate ester wherein the alkyl groups are all fluoroalkyl groups and each has 5 to 11 carbon atoms, based on the total weight of magnesium and phosphate ester in said composition.

7. An incendiary composition according to claim 6 which contains from 10% to 25% by weight of inorganic oxidizer.

8. An incendiary composition comprising 28% to 35% by weight of mono- and/or di-fluoroalkyl phosphate ester wherein the alkyl groups are all fluoroalkyl groups and each has 5 to 11 carbon atoms, 9% to 14% by weight of ferric oxide, 24% to 32% by weight of particulate magnesium, 10% to 15% by weight of particulate silicon, and 10% to 25% by weight of potassium perchlorate.

9. In a process for making an incendiary composition by mixing particulate magnesium, a fluorocarbon oxidizer, an inorganic oxidizer and a heat-transfer promoter, casting the resulting mixture in a desired configuration and heating the cast composition to cure it, the improvement which comprises using as the fluorocarbon oxidizer one or more liquid mono- and/or difluoroalkyl phosphate esters wherein the alkyl groups are all fluoroalkyl groups and each has from 5 to 11 carbon atoms.

10. A process according to claim 9 wherein said fluoroalkyl phosphate ester comprises a mixture of monofluoroalkyl phosphate and difluoroalkyl phosphate.

11. A process according to claim 10 wherein said mixture of fluoroalkyl phosphates comprises 28% to 35% by weight of said composition.

* * * * *